US007436313B2

(12) United States Patent
Bassilious et al.

(10) Patent No.: US 7,436,313 B2
(45) Date of Patent: Oct. 14, 2008

(54) PENETRATION SCREEN

(75) Inventors: Nyle Bassilious, Dundee (GB); Gary A. Ross, Edinburgh (GB); Barrie Clark, Dundee (GB)

(73) Assignee: NCR Corporation, Dayton, OH (US)

( * ) Notice: Subject to any disclaimer, the term of this patent is extended or adjusted under 35 U.S.C. 154(b) by 507 days.

(21) Appl. No.: 11/224,177

(22) Filed: Sep. 12, 2005

(65) Prior Publication Data

US 2006/0077065 A1 Apr. 13, 2006

(30) Foreign Application Priority Data

Sep. 30, 2004 (GB) ..... 0421742.8

(51) Int. Cl.
*G08B 21/00* (2006.01)

(52) U.S. Cl. ..... 340/652; 340/568.1; 340/650; 340/653; 340/673; 340/674; 340/675

(58) Field of Classification Search ..... 340/568.1, 340/568.7, 650, 652–653, 673–675, 541, 340/550, 571

See application file for complete search history.

(56) References Cited

U.S. PATENT DOCUMENTS

| | | | | |
|---|---|---|---|---|
| 4,228,425 | A | 10/1980 | Cooke | |
| 4,939,407 | A | 7/1990 | Goo et al. | |
| 5,539,379 | A * | 7/1996 | MacPherson | 340/550 |
| 7,098,444 | B2 * | 8/2006 | Beinhocker | 340/550 |
| 2004/0046660 | A1 * | 3/2004 | Ando | 340/545.6 |

FOREIGN PATENT DOCUMENTS

| | | | |
|---|---|---|---|
| GB | 1 400 882 | A | 7/1975 |

* cited by examiner

*Primary Examiner*—George A Bugg
*Assistant Examiner*—Samuel J Walk
(74) *Attorney, Agent, or Firm*—Michael Chan

(57) ABSTRACT

A penetration screen is disclosed which comprises a substantially planar substrate with, at least, one electrical circuit disposed thereon. The electrical circuit is configured such that, at least, one section of the circuit is electrically isolatable from the remainder of the circuit without causing a fault condition in said remainder of the circuit.

10 Claims, 4 Drawing Sheets

FIG. 4
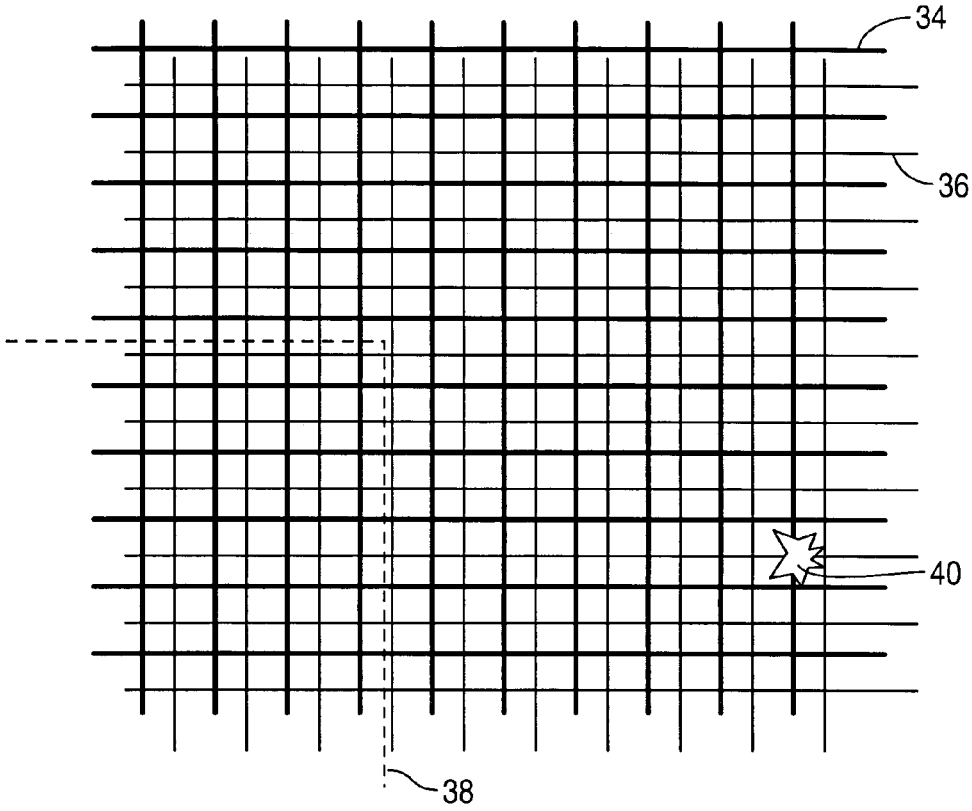
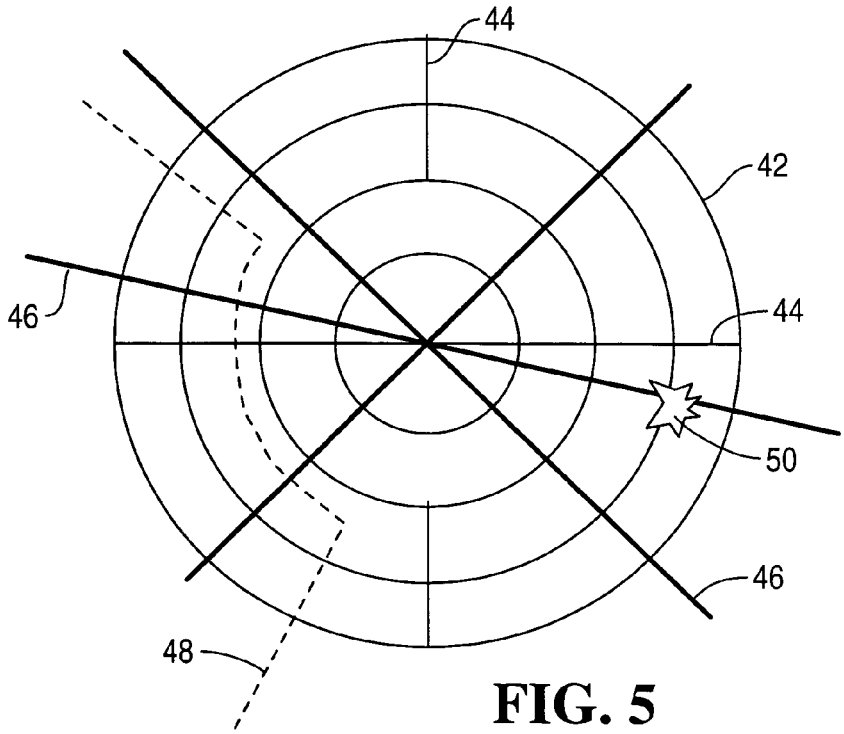
FIG. 5

FIG. 9A
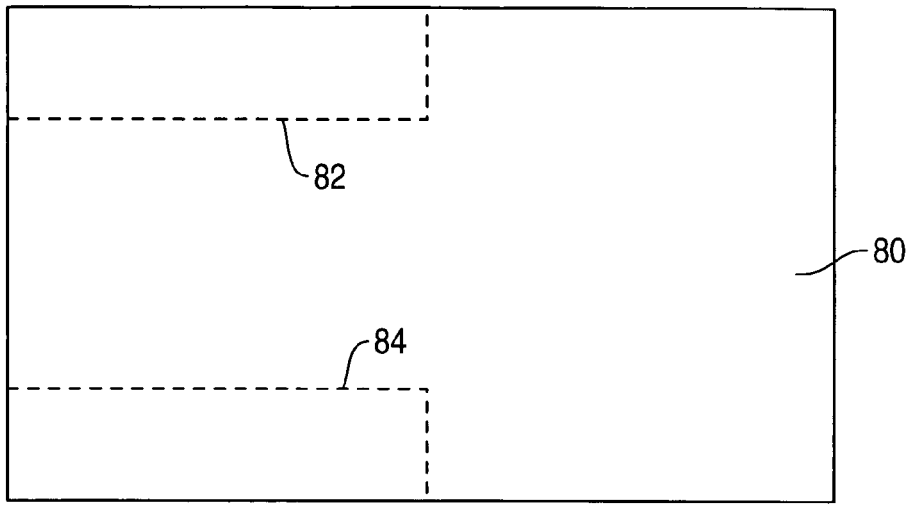
FIG. 9B
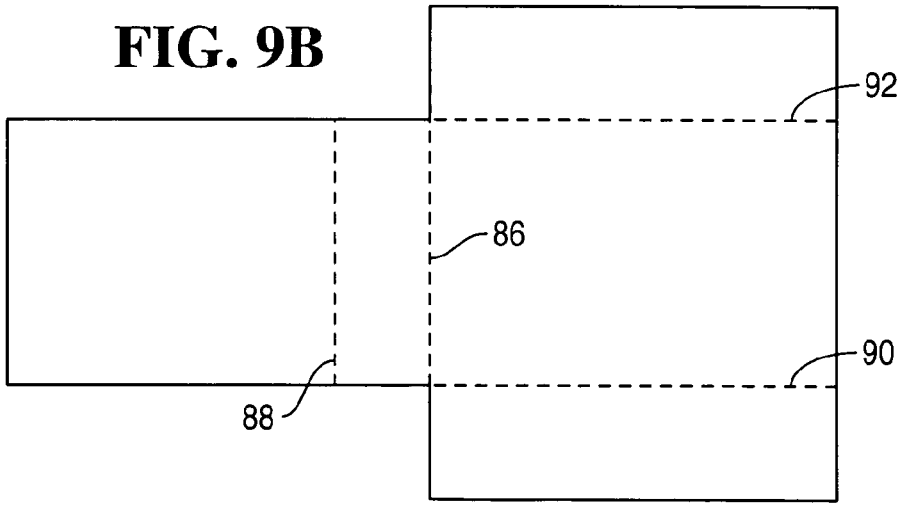
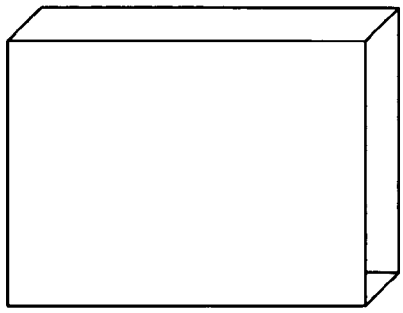
FIG. 9C

PENETRATION SCREEN

BACKGROUND

The present invention relates to a penetration screen and in particular to the use of a flexible planar penetration screen in a security container.

Automated Teller machines (ATMs) and other devices with valuable contents typically employ some form of security. It is also necessary to protect those valuable contents when they are being transported from one location to another. For example, security protection is vital when delivering valuable media, such as bank notes, to an ATM. Therefore, a security system must be devised which will protect the media in the delivery vehicle, whilst it is being carried from the vehicle to the ATM and during replenishment and operation of the ATM.

The security system usually takes the form of an alarm system and a robust security enclosure, such as a safe. However, such security enclosures can be bulky and heavy, which makes them difficult to transport or relocate. It also makes them expensive hence today, for example, a safe makes up a significant amount of the cost of an ATM. Despite the use of dye dispersal systems secure heavy weight safe type enclosures still form the basis of most if not all security systems in this industry.

It may be possible to reduce the bulk and weight of a security enclosure by lining the inner surfaces of the security enclosure with plastic mats, which have two electrode arrays within their laminated construction. When such a mat is damaged by the action of, for example, a drill or thermal lance, a signal is generated to trip the anti-theft countermeasures, for example, an alarm or dye dispersion system. The alarm signal may be generated by the detection of an open circuit in either of the two electrodes, a short circuit between the electrodes, or a combination of both.

However, the mats used in these systems have to be tailored to particular shapes and sizes of enclosure. This has the drawback that expensive re-tooling is needed each time a new enclosure design is introduced and requires a large variety of expensive mats to be held in inventory, thus rendering the solution commercially unviable for the industry.

SUMMARY

It is an object of the preset invention to ameliorate the problems described above.

According to a first aspect of the invention there is provided a penetration screen, the screen comprising a substantially planar substrate with, at least, one electrical circuit disposed thereon, wherein the electrical circuit is configured such that, at least, one section of the circuit is electrically isolatable from the remainder of the circuit without causing a fault condition in said remainder of the circuit.

Preferably, the fault condition is an open circuit.

Most preferably, the circuit comprises a plurality of primary sub-circuits and corresponding secondary sub-circuits, each secondary sub-circuit only being configured for use when the corresponding primary sub-circuit is deactivated.

Still more preferably, the primary sub-circuits are each adapted to be deactivated by punching a hole in a predefined section of said sub-circuit.

In one embodiment the circuits are disposed on both sides of the substrate.

Alternatively, the fault condition is a short circuit.

In this embodiment, most preferably there is an independent circuit on either side of the substrate, the circuits being arranged with respect to each other such that the substrate can be cut along predetermined lines without elements of one circuit coming into contact with elements of the other circuit.

Preferably, the circuits on either side of the substrate are each arranged in grid patterns, said grid patterns being offset with respect to each other.

Most preferably, the grid patterns are both rectilinear grid patterns.

Alternatively, one circuit is arranged in a substantially circular grid pattern and the other circuit is arranged in a substantially radial grid pattern.

Preferably, the grids are intersect, on opposite sides of the screen, at distinct points.

According to a second aspect of the present invention there is provided a security container formed, at least, in part from a penetration screen comprising a screen having a substantially planar substrate with, at least, one electrical circuit disposed thereon, wherein the electrical circuit is configured such that, at least, one section of the circuit is electrically isolatable from the remainder of the circuit without causing a fault condition in said remainder of the circuit.

According to a third aspect of the present invention there is provided a method of manufacturing a security container, utilizing a screen as described above, comprising the steps of: selecting areas of said screen to form the container and electrically isolating the sections of electrical circuit in the remaining areas of the screen not for use in the container, and folding the screen so that the selected areas form the shape of the container.

Preferably, the areas of the screen not for use in the container are cut from the screen without causing a fault condition in the electrical circuit in the areas of the screen being used to form the container.

BRIEF DESCRIPTION OF THE DRAWINGS

Embodiments of the present invention will now be described, by way of example, with reference to the accompanying drawings, in which:

FIG. 4 shows a circuit in accordance with one embodiment of the invention;

FIG. 5 shows a circuit in accordance with a further embodiment of the invention;

FIGS. 9A to 9C show a penetration screen cut and folded to provide a security enclosure.

DETAILED DESCRIPTION

Figure 1:
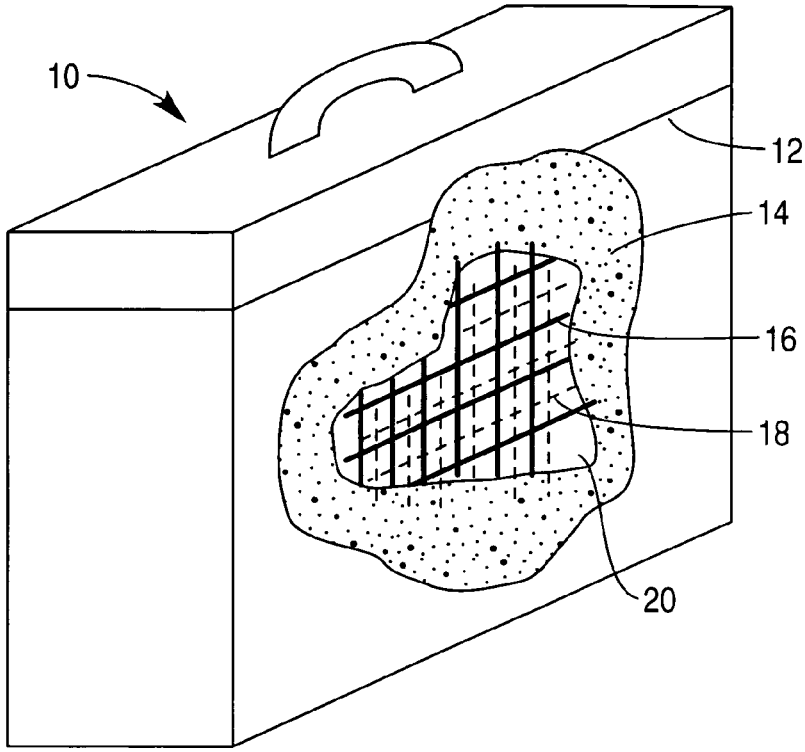
FIG. 1 schematically illustrates a security container incorporating a penetration screen in accordance with embodiments of the present invention.

FIG. 1 schematically illustrates a security container 10 in which a section is cut away to illustrate more clearly the formation of the container 10.

The container of FIG. 1 comprises a container wall 12 equipped with or formed from a penetration screen 14 comprising a substantially planar substrate 20 with one electrical circuit 16, 18 disposed on opposite sides of the substrate 20. Although only shown here for one side of the security container 10, the security screen can be fitted over the different internal surfaces of the security container. Alternatively, the security screen can be fitted to the external surfaces of the security container. It is also possible to replace the container wall 12 by the penetration screen, the screen itself being suitably reinforced, for example by epoxy resin.

As will be described in greater detail below the electrical circuits 16, 18 are configured such that, at least, one section of the circuit is electrically isolatable from the remainder of the circuit without causing a fault condition in said remainder of the circuit.

The container 10 provides protection against theft of the contents and may be an in-situ container, for example, as installed in a self-service terminal (SST) such as an automated teller machine (ATM), or as an in-transit container such as used to convey bank notes from one location to another. For example, the container may be a removable ATM cash cassette for installation in an ATM.

As will be described in more detail below, the penetration screen can provide a signal used to detect physical penetration of the screen, and hence, the security container 10.

SHORT CIRCUIT EMBODIMENT

Figure 2:
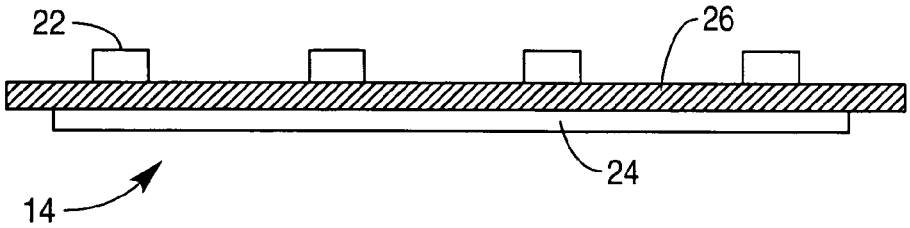
FIG. 2 schematically illustrates a penetration screen in accordance with a first embodiment of the invention.

FIG. 2 schematically illustrates a penetration screen 14 showing an "upper" electrical circuit 22 and "lower" electrical circuit 24 disposed on opposite sides of the flexible substrate layer 26.

Figure 3:
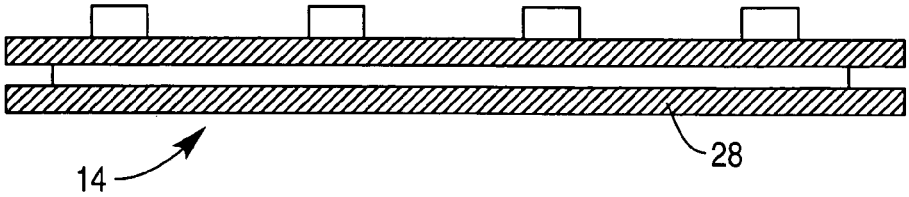
FIG. 3 shows the screen of FIG. 2 with an additional insulating layer.

FIG. 3 shows the screen structure of FIG. 2 with an additional insulating layer 28. The additional insulating layer 28 allows screens to be stacked in multiple layers to improve penetration coverage and sensitivity.

The circuits 22, 24 can be deposited on a flexible substrate by known deposition techniques. The circuits may be formed be any suitable electrical conductor, for example, polymer electrodes and the substrate can be any suitable flexible surface such as paper. It is known to deposit circuits on such substrates utilizing ink-jet printing technology. The use of such technology allows for large-scale printing techniques be used to manufacture penetration screens, which in turn lowers the manufacturing costs of penetration screens and security containers in accordance with the present invention.

In addition, the circuits can be manufactured from materials that can register a thermal or physical attack. One such material is QTC (Quantum Tunnelling Composite) which reacts under thermal or physical influence in that its electrical resistance decreases under pressure or heat. This can then be sandwiched between two layers of a flexible conductive substrate (isolated if need be on the exterior) as part of an alarm circuit, in accordance with the present invention. Therefore once penetrated by a drill or other device or when heat of an attack level is detected then the alarm will be triggered.

In another embodiment, the circuits may be manufactured using conductive ink on a suitable substrate, either laminated paper or composite/plastics based. There are specific conducive ink printers but there are also conductive inks that can use current print technologies and can print on current associated substrates used e.g. paper, polymer based foil, etc.

In yet another embodiment the circuits can be manufactured utilizing miniaturized sensors known as smart dust or motes, perhaps suspended in paint, to detect any penetrative attack, pressure change, local temperature change or acoustic stimulus, etc. These sensors are capable of communicating with each other and a central processor, which could raise an alarm.

The penetration screen 14 can detect the physical penetration of the security container 10 by monitoring the electrodes 22, 24 and detecting a short circuit condition in the circuits.

For example, if an attempt is made to penetrate the security container 10 with a metal implement such as a drill, then when the drill bit passes through the penetration screen there will be a short circuit between the electrodes 22 and 24. The short circuit is detected by a control means (not shown) and the security system for the container is triggered. This can lead to an alarm being sounded or to the actuation of a dye staining system, such as that provided by Fluiditi Limited, England.

Different circuit configurations are possible, as illustrated in FIGS. 4 and 5. The key requirement of the circuit configurations for the short circuit embodiment is that there is an independent circuit on either side of the substrate, the circuits being arranged with respect to each other such that the substrate can be cut along predetermined lines without elements of one circuit coming into contact with elements of the other circuit.

FIG. 4 shows one possible circuit configuration with two circuits 34, 36 disposed on opposite sides of an insulating substrate. The insulating substrate is not show here for simplicity. Each circuit 34, 36 is composed of a grid of conductors. The two circuits are arranged orthogonal to each other, that is, the lines of each grid are not coincident and lie at right angles to each other.

The orthogonal, rectilinear grid layout shown in FIG. 4 has several advantageous features.

Firstly, the layout of the orthogonal electrodes allows the screen to be cut to a convenient shape to be formed into a penetration screen. The dashed line 38 in FIG. 4 shows one possible pattern to be cut into the screen. The separation between the two circuits is sufficient to prevent the circuits from coming into contact with each other and causing a short circuit. Therefore, cutting along line 38 will not cause a short circuit condition between the electrode arrays.

This means that a wide variety of different shapes can be made from the same basic penetration screen. For example, a box shaped penetration screen can be assembled for insertion into a suitable security container. Similarly, other shapes can be cut and assembled. Thus, if one uses the configuration shown in FIG. 4, then there is no need to individually tailor the manufacturing process of penetration screens to different applications or designs of container.

Secondly, a short circuit may be caused by the mechanical destruction of the screen, the short circuit arising from the circuits either contacting directly or via conductive tools such as a drill, or a knife. For example, if a conducting implement, for example a drill bit, penetrates the screen at the position indicated by 40, then a short circuit would be caused. Furthermore, the positioning of the two grids of electrodes means that if the penetration screen was disturbed by a non-conducting implement or explosive blast, the conductors are close enough that they may be forced into contact with each, again causing a short circuit.

FIG. 5 shows another possible configuration of electrical circuit with two electrode arrays used to detect short circuit conditions in a penetration screen.

This configuration is based on a non-rectilinear electrode layout and has a series of concentric, circular electrodes 42 overlaid with occasional radial conductors 44, disposed on the opposite side of an insulating substrate to a series of radial electrodes 46. A possible path to cut the screen along is shown at 48. Again, the penetration screen can detect if there is a short circuit between the electrode membranes, for example, if a conducting implement penetrates the electrode membrane at the position indicated by 50.

This non-rectilinear configuration shares the same advantages as the one shown in FIG. 4 but illustrates that different configurations are possible and not strictly limited to rectilinear grids. It will be understood by the skilled person that different electrode array configurations on the electrode membrane will allow different patterns to be cut out of the electrode membrane.

It will be appreciated that the configuration of circuits illustrated in FIGS. 4 and 5 should only be cut between conductor runs or substantially at right angles to conductor runs to ensure that cutting the screen does not produce a short circuit.

OPEN CIRCUIT EMBODIMENT

Figure 8:
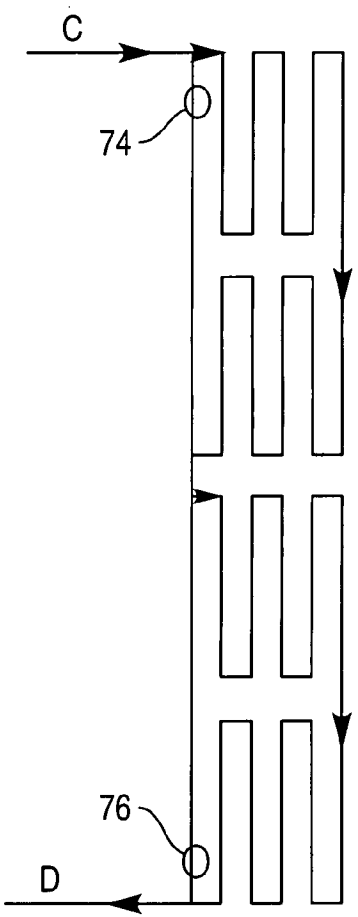
FIG. 6 to 8 show a circuit in accordance with yet another embodiment of the invention.
Figure 7:
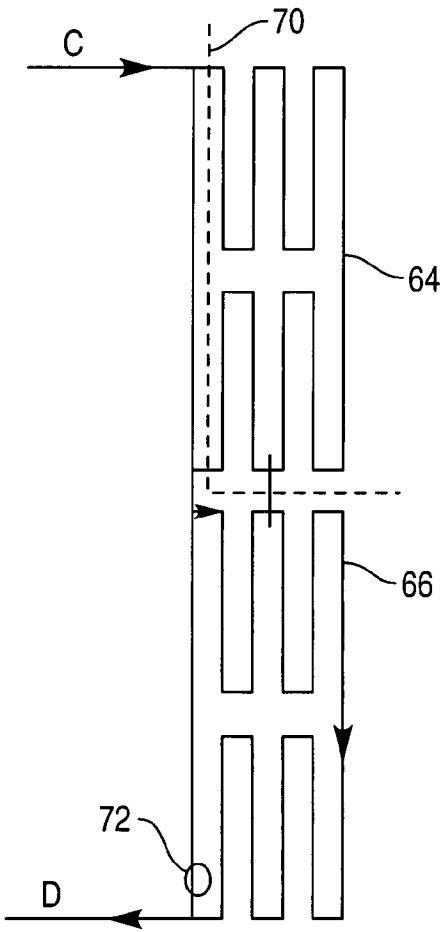
Figure 6:
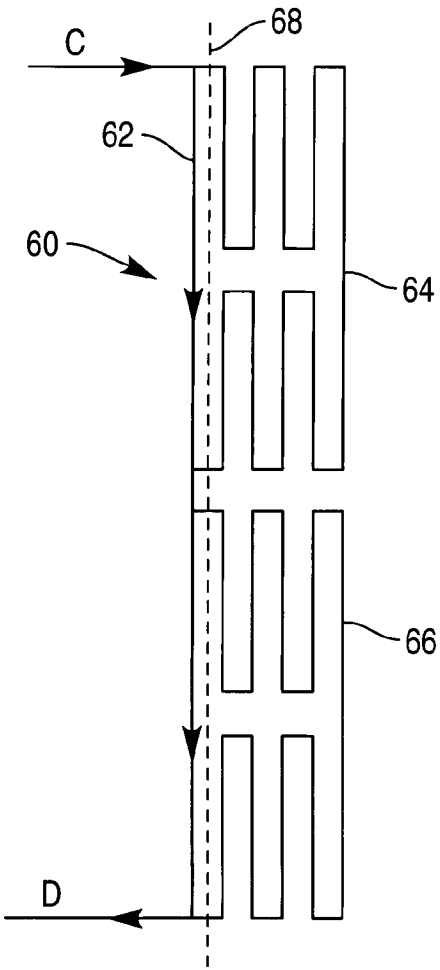

FIGS. 6 to 8 show possible circuit configurations used to detect open circuit conditions in a penetration screen, in accordance with a further embodiment of the present invention.

In FIGS. 6 to 8 the circuit comprises a plurality of primary sub-circuits 62 and corresponding secondary sub-circuits 64, 66 each secondary sub-circuit only being configured for use when the corresponding primary sub-circuit is deactivated. In each circuit 60 the primary sub-circuits 62 are each adapted to be deactivated by punching a hole in a predefined section 72, 74, 76 of said sub-circuit.

The secondary sub-circuits 64, 66 are arranged in a convoluted, rectilinear pattern. This type of pattern maximizes the area covered by the electrode and maximizes the penetration screens sensitivity.

In this configuration, a security screen can detect the creation of an open circuit within either of the two electrically isolatable sub-circuits 64, 66. As before, the open circuit is caused by the mechanical destruction of the membrane.

If appropriate circuit patterns are disposed on both sides of the substrate then the open circuit electrode system can also be configured to operate in the short circuit mode to provide additional protection, in the same ways as described for FIGS. 4 and 5.

FIG. 6 illustrates one instance of the open circuit in which neither secondary sub-circuit 64, 66 is required. In this case the screen can be cut along dashed line 68, without causing a fault condition in the form of n open circuit. Consequently, current flows from point C to D along the path indicated by the arrows.

FIG. 7 illustrates another instance of the open circuit arrangement wherein the first sub-circuit 64 is not required and so a cut is made along dashed line 70. In this instance, second sub-circuit 66 is required to be a part of the open circuit system and so a hole is punched at 72, which open circuits that particular branch of the electrode and forces the current to flow from C to D, as shown by the arrows in FIG. 7.

FIG. 8 is yet another instance of the open circuit electrode system where both the first and second sub-circuits 64 and 66 are required to be activated. In this instance holes are made through the electrodes at points 74 and 76 which cause the current to flow from C to D, as shown by the arrows in FIG. 8.

A shown in FIGS. 6 to 8, the configuration of the open circuit system allows a single screen to be cut into complex shapes without requiring different templates for each different application or design.

FIGS. 9A to C show a practical application of the penetration screen. In this example, the penetration screen is cut so as to fit into a box shaped container, for example of the type used for cash cassettes for ATMs, as illustrated in FIG. 1 or 9C.

FIG. 9A shows the penetration screen 80 in its initial format, that is, as printed and without any modifications. Dashed lines 82, 84 illustrate predetermined lines along which the screen can be cut to provide the box template shown in FIG. 9B, without causing a fault condition. The box template can then be folded along the dashed lines 86-92 to produce the box shape in FIG. 9C.

Modifications may be incorporated without departing from the scope of the present invention. In particular, different cuts and different circuit configurations can be utilized to produce enclosures of different shapes. Also the penetration screen can be strengthened using suitable techniques and materials. For example, the screen can be impregnated and cured with an epoxy resin to provide a solid structure, which can replace the outer walls of a security container or safe. In addition, the areas of the substrate that are not required need not be cut away. Instead those areas may merely be folded so that they provide additional structure to the construction.

What is claimed is:

1. A penetration screen comprising:

a substantially planar substrate; and at least one electrical circuit disposed on the substrate, wherein the electrical circuit is configured such that at least one section of the circuit is electrically isolatable from the remainder of the circuit without causing an open circuit in the remainder of the circuit, wherein the circuit comprises a plurality of primary sub-circuits and corresponding secondary sub-circuits, each secondary sub-circuit being configured for use only when the corresponding primary sub-circuit is deactivated.

2. A screen as claimed in claim 1, wherein each of the primary sub-circuits is adapted to be deactivated by punching a hole in a predefined section of the sub-circuit.

3. A screen as claimed in claim 2, wherein the primary and secondary sub-circuits are disposed on both sides of the substrate.

4. A screen as claimed in claim 1, wherein each of the primary and secondary sub-circuits is manufactured from at least one of (i) flexible conductive polymers, (ii) conductive ink, (iii) miniaturized sensors known as smart dust or motes, and (iv) quantum tunnelling composite (QTC) or other thermal or pressure sensitive material.

5. A screen as claimed in claim 4, wherein the sensors are suspended in paint if each of the primary and secondary sub-circuits is manufactured from miniaturized sensors known as smart dust or motes.

6. A security container formed at least in part from a penetration screen having a substantially planar substrate with at least one electrical circuit disposed on the substrate, wherein the electrical circuit is configured such that at least one section of the circuit is electrically isolatable from the remainder of the circuit without causing an open circuit in the remainder of the circuit, wherein the circuit comprises a plurality of primary sub-circuits and corresponding secondary sub-circuits, each secondary sub-circuit being configured for use only when the corresponding primary sub-circuit is deactivated.

7. A screen as claimed in claim 6, wherein each of the primary sub-circuits is adapted to be deactivated by punching a hole in a predefined section of the sub-circuit.

8. A screen as claimed in claim 7, wherein the primary and secondary sub-circuits are disposed on both sides of the substrate.

9. A screen as claimed in claim 6, wherein each of the primary and secondary sub-circuits is manufactured from at least one of (i) flexible conductive polymers, (ii) conductive ink, (iii) miniaturized sensors known as smart dust or motes, and (iv) quantum tunnelling composite (QTC) or other thermal or pressure sensitive material.

10. A screen as claimed in claim 9, wherein the sensors are suspended in paint if each of the primary and secondary sub-circuits is manufactured from miniaturized sensors known as smart dust or motes.

* * * * *